US010569491B2

(12) United States Patent
Eriksson

(10) Patent No.: US 10,569,491 B2
(45) Date of Patent: Feb. 25, 2020

(54) DOCTOR BLADE DEVICE

(71) Applicant: CS PRODUKTION AB, Säffle (SE)

(72) Inventor: Tore Eriksson, Klässbol (SE)

(73) Assignee: CS PRODUKTION AB, Säffle (SE)

( * ) Notice: Subject to any disclaimer, the term of this patent is extended or adjusted under 35 U.S.C. 154(b) by 18 days.

(21) Appl. No.: 15/546,612

(22) PCT Filed: Dec. 17, 2015

(86) PCT No.: PCT/SE2015/051361
§ 371 (c)(1),
(2) Date: Jul. 26, 2017

(87) PCT Pub. No.: WO2016/122370
PCT Pub. Date: Aug. 4, 2016

(65) Prior Publication Data

US 2018/0022055 A1 Jan. 25, 2018

(30) Foreign Application Priority Data

Jan. 30, 2015 (SE) ..... 1550098

(51) Int. Cl.
*B31F 1/14* (2006.01)
*D21G 3/00* (2006.01)

(52) U.S. Cl.
CPC ..... *B31F 1/14* (2013.01); *D21G 3/005* (2013.01)

(58) Field of Classification Search
USPC ..... 162/111, 281
See application file for complete search history.

(56) References Cited

U.S. PATENT DOCUMENTS 1,845,716 A 2/1932 Lafore
3,122,767 A * 3/1964 Carvill ..... B41F 9/1036 118/70

(Continued)

FOREIGN PATENT DOCUMENTS

CA 2481898 3/2005
GB 360028 11/1931

(Continued)

OTHER PUBLICATIONS

International Search Report issued in PCT/SE2015/051361 dated Aug. 2, 2016, pp. 1-3.

(Continued)

*Primary Examiner* — Jacob T Minskey
(74) *Attorney, Agent, or Firm* — Jeffrey S. Melcher; Melcher Patent Law PLLC

(57) ABSTRACT

The invention below relates to a doctor blade device with an elongated doctor blade intended to operate continuously against a roll surface (2) and/or a cylinder surface (20) during scraping or wiping off material (IB) on the surface (20), which doctor blade device (5) comprises a carrier beam (10) adapted to the length of the roll surface or cylinder surface, which carrier beam has a clamping arrangement (4) for the positioning of a carrier part (3), arranged, in a groove in the longitudinal direction, to slidably carry the doctor blade (6), wherein the carrier part (3) comprises a carrier blade (30), a lip means (14) arranged at the carrier blade (30) and a spacer element (12) arranged between the lip means (14) and the carrier blade, wherein the carrier blade (30), the lip means (14), and the spacer element (12) are arranged, along a first long side edge of the carrier blade (30) between them, to form said groove (15) for slidable positioning in the longitudinal direction of the doctor blade (6) by support of (Continued)

the carrier blade (30), the lip (14), and the spacer element (12).

16 Claims, 4 Drawing Sheets

(56) References Cited

U.S. PATENT DOCUMENTS

| | | | | |
|---|---|---|---|---|
| 3,378,876 | A | 4/1968 | Sisson | |
| 3,529,315 | A | 9/1970 | Dunlap | |
| 3,778,861 | A | 12/1973 | Goodnow | |
| 4,691,406 | A | 9/1987 | Goodnow | |
| 5,138,740 | A | 8/1992 | Goodnow | |
| 5,230,775 | A | 7/1993 | Goodnow | |
| 5,279,710 | A | 1/1994 | Aikawa | |
| 5,403,446 | A | 4/1995 | Trelsmo | |
| 5,783,042 | A * | 7/1998 | Leeman | D21G 3/005 15/256.51 |
| 6,202,252 | B1 | 3/2001 | Harrisson | |
| 6,547,932 | B1 | 4/2003 | Leinonen | |
| 6,651,303 | B1 | 11/2003 | Toivanen | |
| 2004/0237884 | A1 | 12/2004 | Rata | |
| 2015/0122444 | A1 | 5/2015 | Brauns | |

FOREIGN PATENT DOCUMENTS

| | | | |
|---|---|---|---|
| JP | S63-66395 | A | 3/1988 |
| JP | H2-66700 | U | 5/1990 |
| JP | H3-59396 | U | 6/1991 |
| JP | H5-96098 | U | 12/1993 |
| JP | H10-325094 | A | 12/1998 |
| JP | 3264798 | | 3/2002 |
| WO | 9725475 | | 7/1997 |
| WO | 2008103115 | | 8/2008 |
| WO | 2014/17690 | | 10/2014 |

OTHER PUBLICATIONS

Written Opinion issued in PCT/SE2015/051361 dated Aug. 2, 2016, pp. 1-4.

European Search Report Issued in European Patent Application No. 15880336.1, dated Oct. 1, 2018, pp. 1-7.

Office Action Issued in corresponding Japanese Patent Application No. 2017-536005, dated Oct. 25, 2019, pp. 1-4, translation pp. 1-6.

* cited by examiner

DOCTOR BLADE DEVICE

TECHNICAL FIELD

The present invention relates to a doctor blade device with an elongated doctor blade intended continuously to operate against a roll surface or a cylinder surface during the scraping off or wiping off material on the surface, which doctor blade device comprises a holder adapted to the length of the roll surface or the cylinder surface with a groove adapted to the thickness of the doctor blade for the reception of a long side of the doctor blade, the other long side of which protrudes out of the holder groove, which groove is dimensioned to admit slidable positioning in the longitudinal direction of the doctor blade with support of walls defining the groove.

Here, "doctor blade" means a thin ruler or a thin blade, usually of metal, which continuously operates against a roll surface -or a cylinder surface during the scraping off or wiping off operation.

Below, the doctor blade will be described at the use for creping off a paper web from a Yankee cylinder in a soft paper machine, but the doctor blade device can, of course, also be used for scraping of fmaterial from other roll surfaces—or cylinder surfaces and also in other machines than paper machines, and also in certain applications for the smoothing of sludge layers and scraping off excess at coating and at printing.

PRIOR ART

At the manufacture of soft paper, e.g. toilet paper, household paper, table napkins and similar sanitary products, the softness and the absorption ability of the paper is achieved through a so called creping method. This method is performed such that the still wet fibre layer/web, created at the forming of the paper, is brought onto a drying cylinder and that the entirely dried, or partly dried, web is scraped off and is pulled off at the outlet side of the cylinder, and thereafter it is brought further to any subsequent possible additional drying and/or reeling. Within this industry field, these drying cylinders are called "yankee cylinders". The characteristic feature of these cylinders is the large diameter, which is 3 to 5 m. The drying of the paper web takes place through the contact with the warm surface, which is usually warmed up by an interior steam supply as well as exterior hot air, sometimes completed with an IR radiation.

The so called creping is thus performed at the above mentioned removal (scraping). In this process, the running web is "scraped" from the cylinder by a so called opposing blade, which with a certain pressure abuts against the cylinder surface. As the running web meets the blunt surface of said blade, a micro-creasing of the web/paper takes place. This micro-creasing, which is also called creping, increases the thickness and the softness of the paper. A prerequisite for a creping to arise is that the running web has a certain adhesion against the cylinder surface. This adhesion may occur naturally by the paper not being entirely dried or by the fibre composition containing components adhering against the cylinder surface. A frequent method to achieve the desired adhesion, however, is to provide the cylinder surface with glueing agents from the outside. This is usually performed by the glueing agent in a low concentration being sprayed on the cylinder surface.

The actively acting machine component in the creping process is thus an opposing blade, also called creping doctor blade, which at a certain pressure abuts against the cylinder surface and the long side of which has an abutment area, which scrapes off and micro-creases the paper. The creping doctor blade is positioned in a holder, usually a beam, having the following main functions:

- To achieve an adjustable abutment pressure of the creping doctor blade against the cylinder;
- To make pushing -and pulling of the creping doctor blade possible;
- To make a quick exchange of creping doctor blades possible.

The contact of the creping doctor blade with the cylinder surface exposes both the creping doctor blade and the cylinder surface to wear. This implies negative consequences in the process, in the form of wear. The wear consequence is, as the creping doctor blade is concerned, that it has to be exchanged, which besides the costs of the creping doctor blade implies considerable costs for loss of production at the exchange.

The wear consequence for the cylinder surface is that costly re-grindings of the surface have to be performed now and then. As the cylinder is a pressure vessel, the cylinder must also have a certain jacket thickness. This implies that the cylinder has to be coated with a new wear surface after a certain number of re-grindings. Another consequence of the wear of the creping doctor blade is that the quality of the creped paper is changed with the extent of wear.

To reduce the wear, it is important to keep as small a pressure as possible between the peak of the creping doctor blade and the cylinder surface. However, a certain minimum pressure has to be maintained to prevent the paper web or parts of the paper web to pass between the creping doctor blade and the cylinder surface, which would otherwise cause web breakage.

In the patent publication US 2010/0032112 (Eriksson), a method and a device for creping is described, where traditional creping blades are replaced by a band which is continuously or discontinuously fed forward in the transversal direction of the paper machine. During the development process it has proved that the preferred embodiment of the invention has suffered from mainly two problems. One problem is that the preferred embodiment required an exchange of the entire blade holder unit, which implied large investment costs for the user.

A conventional blade holder unit is shown and described in U.S. Pat. No. 3,778,861 (Goodnow). The holder unit has two chambers, and the doctor blade is protruding out of one chamber, and a press blade abutting the doctor blade protrudes out of the other chamber. The invention which is described in US 2010/0032112 (Eriksson) cannot be used together with the blade holder unit according to U.S. Pat. No. 3,778,861 (Goodnow).

An exchange of traditional creping blades by a continuously or discontinuously fed band is known through e.g. U.S. Pat. No. 5,138,740 (Goodnow et al.), where two band ends can be joined to each other, and the band can be used in the blade holder unit according to U.S. Pat. No. 3,778,861 (Goodnow).

Other doctor blade devices using doctor blade bands are known through e.g. U.S. Pat. No. 6,651,303 (Toivanen et al.) and U.S. Pat. No. 6,202,252 (Harrison), but neither of these ones can be used together with conventional blade holder units such as the one in U.S. Pat. No. 3,778,861 (Goodnow) mentioned above. In U.S. Pat. No. 6,202,252 (Harrison) it is also shown that the long sides of the doctor blade band can be inverted-symmetrically bevelled. After the use of the first bevelled edge, the band is rolled onto a coil, and after the turning of the coils upside down the unused bevelled second edge can be used for the doctoring.

The second problem with the invention according to US 2010/0032112 (Eriksson) consists in the fact that the part carrying and controlling the creping band is not flexible enough to generate an even band pressure along the entire cylinder surface, because of its sandwich construction and its firm clamping in the carrying beam. An uneven band pressure results in an uneven wear of the creping band and can also cause wear damages on the roll surface—or the cylinder surface. The difficulties to obtain an even band pressure can partly be caused by the the fact that the he roll surface—or the cylinder surface has been bent because of the roll/cylinder being loaded such that its axis of rotations has been bent, that the roll surface—or cylinder surface is cambered, or that the cylinder is subject to an inner over-pressure.

The duration of the creping doctor blade can be increased, when the peak and the contact surface of the doctor blade against the cylinder has a coating of a harder material than the base body itself of the creping doctor blade. Examples of this solution are described in GB 2128551. The problem with this solution is that the harder material can easier damage the cylinder surface, through e.g. wear.

In order to reduce the wear of the cylinder surface, the agent increasing the adhesion of the paper web against the cylinder surface can be combined with an agent building up a layer on the cylinder surface. In this way, the peak of the creping doctor blade will "scrape" in the layer formed instead of "scraping" against the cylinder surface. The drawback with this method is i.a. a high consumption of chemicals and a deteriorated heat transport through the cylinder as well as that chemical residues are mixed with the paper.

Even if the running times of the creping doctor blades can be prolonged with the methods mentioned above, the creping doctor blade must, however, be exchanged after more or less long production intervals. Trials have been made to reduce this problem through continuous feeding of a long traditional creping doctor blade in its longitudinal direction. Some, of several problems which have resulted in the method having not become popular on the market is that the construction implies a costly maintenance, that the adjustment possibilities are limited, that the method requires a large space on both sides of the machine, and that the consumption of doctor blades will be high because of the feeding speed having to be so high that the difference in wear between the input - and output side results in quality differences between the two sides.

DISCLOSURE OF THE INVENTION

The object of the present invention is to achieve a doctor blade device with continuous or intermittent longitudinal feed of a doctor blade, which can be used in conventional blade holder units and which does not require any exchange thereof.

According to the invention, this object is achieved, in a doctor blade device of the kind mentioned in the first item above, a holder comprises a carrier blade, a lip means, and a spacer element arranged between the lip means and the carrier blade, wherein the carrier blade, the lip means and the spacer element are connected with each other in such a way that they along a first long side edge of the carrier blade between each other form said groove intended for a slidable positioning in the longitudinal direction of the doctor blade with support of the carrier blade, the lip and the spacer element.

Thanks to the invention, the advantage of heavily reduced installation costs is achieved, as existing blade holder units can be re-used and that production losses in connection with the installation can be considerably reduced.

In order to reduce the bending resistance, it is suitable that the spacer element is divided into a number of successive spacer element parts, that the lip means is divided in a number of successive lip parts, and that the number of spacer element parts is as large as the number of lip parts. Suitably, the connection is made with screws and rivets (possibly welding and/or glueing, wherein it is suitable that the number of screws or rivets is twice as large as the number of spacer element parts and lip parts, and that each screw or rivet penetrates a lip part and a spacer element part, but preferably not emerges outside the outer surface of the carrier blade, which at that location preferably is smooth for a flexible interaction with a press mechanism.

In order further to reduce the bending resistance, the carrier blade preferably has a plurality of transverse stress relieving slots, which emanate from a second long side edge of the carrier blade, and which are evenly distributed along the length of the carrier blade. Suitably, these slots have a length of 50% to 70% of the width of the carrier blade. The slots reduce the thermal stresses in the carrier blade which are caused by an uneven temperature distribution.

Preferably, said second long side edge of the carrier blade rests against the bottom of a chamber formed between a first lip and a second lip in a doctor blade beam or any other carrier beam, wherein the chamber is so designed that it admits a certain tilting of the carrier blade in the recess, while the carrier blade rests against said bottom. The tilt-ability, which is important for the function and which in US 2010/0032112 (Eriksson) was a weakening in the vicinity of the firmly clamped part, can thus according to the invention take place in the support point of the carrier blade in the carrier beam.

Preferably, the carrier beam comprises a second chamber formed between said second lip and a third lip, and a press blade extends from a bottom in said second chamber between the second lip and the third lip to a line abutment against the carrier blade along a line in connection to the bottom of the groove for the doctor blade. In this way, the achievement of an even abutment pressure for the doctor blade is achieved.

It is suitable that the doctor blade has a length, which is several times larger than the length of the roll surface-or the cylinder surface, against which the doctor blade is to operate and which thus is band-shaped. In this way, reduced stopping times are achieved at the exchange of blades.

If desired, the ends of the doctor blade band are joined to each other for the forming of a continuous doctor blade band.

For a doctor blade, which is to be used for the creping of a soft paper web, it can be suitable that at least one long side edge of the doctor blade is ground to an angle of about 60° to about 90° in relation to adjacent sides of the doctor blade in many cases to give a (not limiting) desired angle of about 80° to about 110° between the ground surface and a tangent to the roll surface—or the cylinder surface in the abutment point of the doctor blade against the roll surface—or the cylinder surface.

If desired, both long side edges of the doctor blade band can be ground such that the doctor blade band has a rotation symmetrical cross-section, and that one band end at the joining of the ends has been turned half a turn in relation to the other one for the forming of a Möbius-band with only one side and only one long side edge. In this way, the continuous operation time for the doctor blade band can be doubled between the exchange of bands.

BRIEF DESCRIPTION OF THE ENCLOSED DRAWINGS

Below the invention will be described more in detail with reference to the preferred embodiments and the enclosed drawings, of which:

DETAILED DESCRIPTION OF PREFERRED EMBODIMENTS

Figure 1:
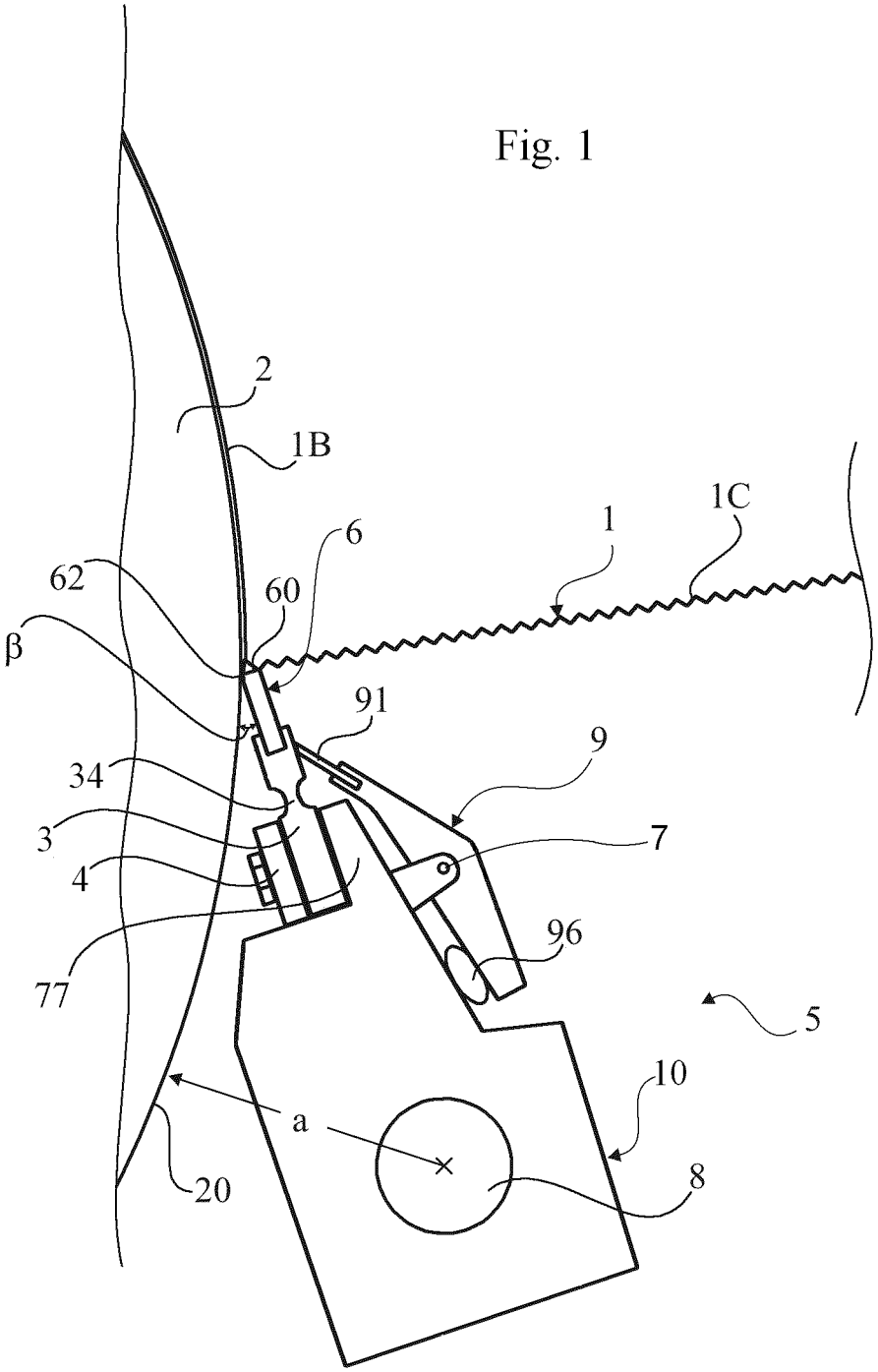
FIG. 1 is a schematic side view of a known creping doctor blade (US 2010/0032112 (Eriksson)), which view shows the principles thereof.

FIG. 1 shows a side view of a creping doctor blade device 5 according to US 2010/0032112 (Eriksson), by means of which a soft paper web 1B adhered to the jacket surface 20 of a Yankee cylinder 2 is creped off from the jacket surface 20 during the formation of a creped soft paper web 1C. The creping doctor blade device 5 is pivotally suspended in a securing part 8, here preferably in the form of axle stubs. Through the rotary motion, the creping doctor blade device 5 can be positioned in an operation position and a disconnected inactive position. The creping doctor blade device comprises a carrier beam 10 consisting of an elongated body with securing means (e.g. circular recesses) intended for said axle studs. There is a heel 77 at the upper portion of the body, in which heel a holder part 3 is clamped with a holding arrangement 4. A doctor blade 6 (which can also be designated as a scraping blade) is slidably/movably arranged in a gap in the holder part 3. With the aim to be able to use this construction optimally there is a pivotable link 34, here in the form of a waist constituting a pivotal, resilient link. By pivoting the portion above the pivot link 34, the doctor blade 6 can be given different pressures and/or angles β for its abutment against the jacket surface. The result of the creping operation, i.e. i.a. the thickness and macro-structure of the creped paper web 1C, is, however, not in the first place controlled by the angle β but by the so called pressure—or shock angle between the up-stream segment of a tangent to the mantel surface 20 in the abutment point 62 of the doctor blade 6 and the abutment—or shock surface 60 for the arriving web 1B.

Further, a press device 9 is shown, consisting of an elongated (or in the longitudinal direction divided/sectioned) body and which approximately in the middle of said body is pivotally arranged about a pivot point 7. At the upper end of the press body there is a press means 91 (which can be elongated or sectioned), which with its end abuts against the holder part 3 along a line above said link point 34, so that a pressure by means of the press means 91 can influence the press force of the doctor blade 6. The press force can be applied by one press means 96, or more, (preferably a flexible, inflatable hose) in order to control the abutment pressure against the jacket surface 20 at its contact line 62.

Figure 2:
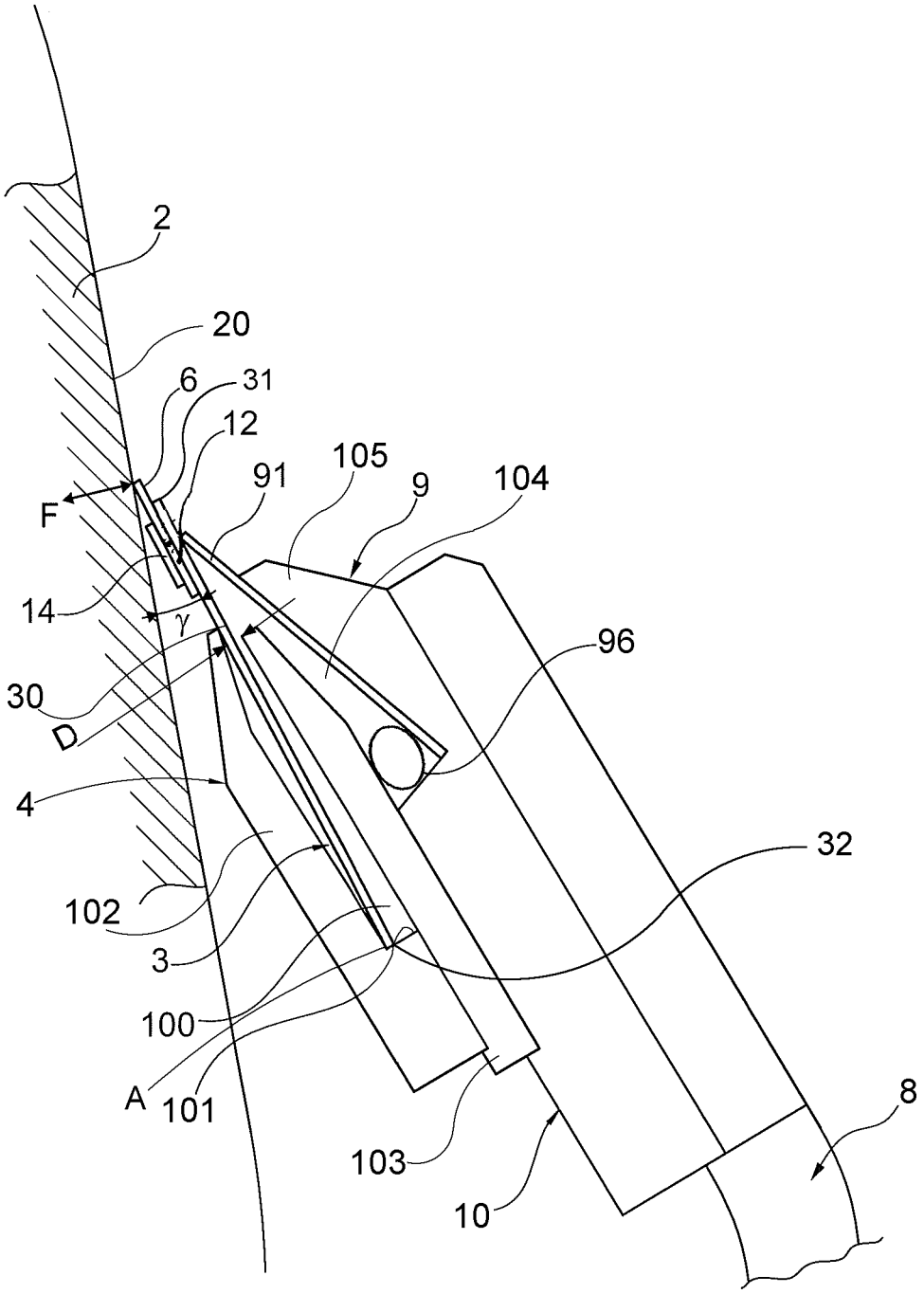
FIG. 2 is a schematic side view of a creping doctor blade comprising a doctor blade device according to the invention with a doctor blade and a holder, which is mounted in a known type of traditional carrier beams and comprises a carrier blade, a lip means, and an intermittent spacer element and is held in a carrier beam, which also holds a press blade abutting against the carrier blade.

FIG. 2 shows a view from the side of an embodiment according to the invention. An important difference in relation to prior art shown in FIG. 1 is that the invention can use a holder device 8 and a carrier beam 10 in accordance with a conventional, generally used embodiment. FIG. 2 shows a type of conventional holder devices 8 with a conventional carrier beam 10 and a conventional press arrangement 9, at which a doctor blade arrangement 3, 6, 12, 14 is arranged according to a preferred embodiment of the invention.

The doctor blade arrangement according to the invention comprises a holder part 3 in the form of a carrier blade 30, at the upper end of which a movable wear part 6 is arranged. The wear part 6 is movably arranged in a gap 15 (see FIG. 4), which is arranged between a lip means 14 and the upper end of the carrier blade. Spacer elements 12 are arranged between the lip means and the carrier blade 30 in order to create a desired gap 15, which enables a steady provision of the wear part 6 but with enough space in the gap 15 to be able to displace the wear part 6 in its longitudinal direction in a desired way. The carrier blade 30 is arranged in a first chamber 100, which is arranged between a first lip 102 and a second lip 103 in the carrier beam 10, which lips are preferably designed in accordance with conventional doctor blade technique. According to a preferred embodiment of the invention, the carrier blade 30 is designed such that a traditional doctor blade can be used as initial material, which implies many advantages also from a cost point. Thus, the carrier blade 30 is suitably made of steel and suitably has a thickness T in the region of 0.5 mm to 3 mm and a width B in the region of 75 mm to 150 mm. The carrier blade 30 abuts with its lower end 32 against the bottom 101 of the chamber 100 and is during operation with its lower end 32 clamped in an outer corner A of the bottom, which corner A then functions as a kind of pivot point for the carrier blade 30 and which enables that the holder blade can flex inside the space in the first chamber 100 and in the gap D formed at the top between the lips 102, 103 for abutment by a certain angle y. Suitably, the chamber 100 has a width essentially exceeding the thickness t of the holder blade 30. Further, it can be seen that the carrier beam 10 is provided with a second chamber 104, inside which a press blade 91 is arranged as well as an equalizing means 96 being a part of a press device 9, also in accordance with prior art. By means of the equalizing means 96 in interaction with a third lip 105, the pres force F of the press blade 91 can be adjusted in a manner known per se and hence exert a desired pres force on the holder part 3 and hence the wear part 6 in abutment against the surface 20 of the roll 2. During operation, the wear part 6 can be moved either at certain intervals or continuously in order to renew the wear surface 60 with the wear part 6. The wear part is suitably made of steel with a thickness tin the region of 0.4 mm to 1.5 mm and a width B in the region of 10 mm to 30 mm.

Figure 3:
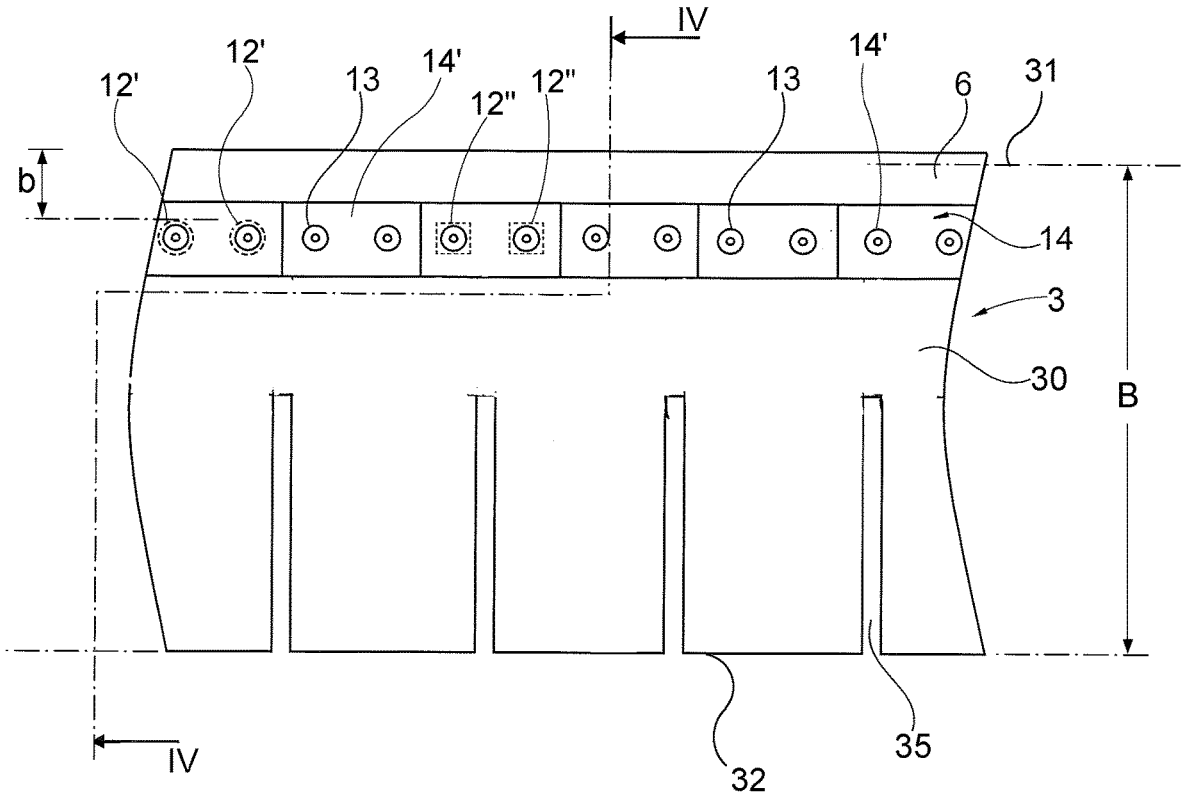
FIG. 3 is a plan view of a part of a preferred embodiment of the holder.

FIG. 3 shows a part of a carrier blade 30 according to the invention seen from the front. As can be seen, the lip means 14 is suitably arranged in the form of a plurality of separate elements 14', which are attached to the carrier blade 30 by means of screw elements 13. In the left part of FIG. 3 it is shown that circular washers 12', preferably standard washers of stainless steel, are preferably used as spacer elements 12 to achieve a desired gap S between the carrier blade 30 and the lip means 14 to accommodate the wear part 6 without clamping. At a position nearer the middle of FIG. 3 it is indicated that the spacer element 12 can also have another design, for instance in the form of rectangular washers 12". It is realized that that spacer element 12 can, of course, also consist of an elongated continuous unit, either in itself or integrated with the lip means 14.

Figure 4:
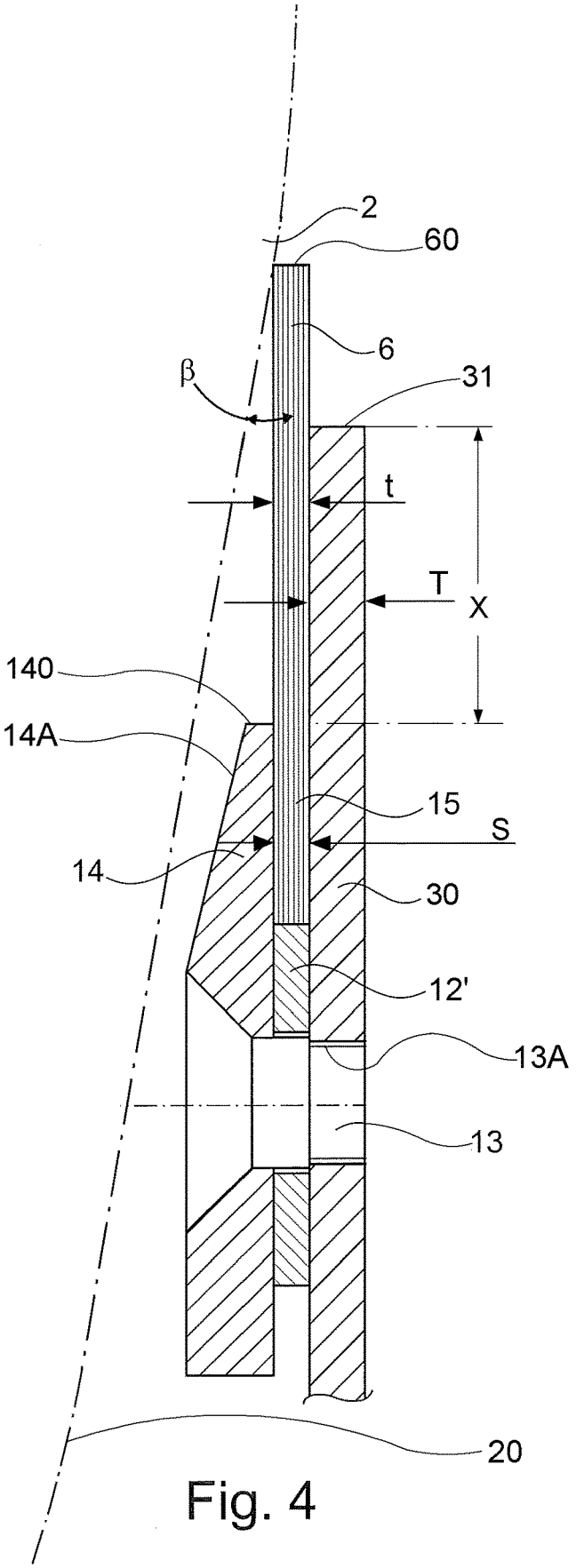
FIG. 4 is an enlarged cross-sectional view of the doctor blade and adjacent parts of the holder taken along the line IV-IV in FIG. 3.

FIG. 4 shows a cross-section of the upper part of a carrier blade 3 with a wear part 6, as is indicated in FIG. 3. As can be seen, the wear part protrudes a distance enough down into the gap 15 formed between the lip means 14 and the upper part 31 of the carrier blade in order to obtain support enough for the abutment against the roll 2. Further, it is shown that the lip means 14 with its upper end 140 is arranged at a distance X (suitably about 3 mm to 15 mm) below the upper end 31 of the carrier blade in order to be able to create space enough between the wear part 6 and the roll surface to arrange the wear part 6 at a desired angle β in relation to the roll surface 20 and that, with the same aim, the upper part of the lip means is advantageously provided with a bevel 14A. Further, it is shown that the washer 12 is advantageously arranged by means of screws 13 having lock threads 13A or is in another way safely secured in the carrier blade 3. Preferably, the screws 13 are hard clamped against the washer 12, which can further guarantee safe anchorage. A possible modification is to provide a circular washer 12', which by not being clamped against the carrier blade 3 can be arranged, so that is freely rotatable about the screw 13, whereby a displacement of the wear part 6 can be further facilitated.

The invention claimed is:

1. A doctor blade device with an elongated doctor blade configured to operate continuously against a roll surface and/or a cylinder surface during scraping or wiping off material on the surface, which doctor blade device comprises:

a carrier beam adapted to the length of the roll surface or cylinder surface, which carrier beam has a clamping arrangement for the positioning of a carrier part, arranged to slidably carry the doctor blade in a groove in the longitudinal direction, wherein the carrier part comprises a carrier blade, a lip means arranged at the carrier blade and a spacer element arranged between the lip means and the carrier blade, wherein the carrier blade, the lip means, and the spacer element are arranged to form between them, said groove along a first long side edge of the carrier blade, to facilitate slidable positioning in the longitudinal direction of the doctor blade by support of the carrier blade, wherein the carrier blade has a plurality of transverse relief slots emanating from a second long side edge of the carrier blade and that the lip means is divided into a number of successive lip parts.

2. The doctor blade device according to claim 1, wherein said carrier beam is provided with a first chamber arranged to accommodate the second long side edge of the carrier blade, opposite the first long side edge of which is positioned outside of said chamber.

3. The doctor blade device according to claim 2, wherein said chamber has a smallest opening in the longitudinal direction, which opening is larger than the thickness of the carrier blade, wherein the chamber is so designed that it admits a certain tilting of the carrier blade in the recess while the carrier blade rests against said bottom.

4. The doctor blade device according to claim 2, wherein said chamber has a smallest opening in the longitudinal direction, which opening is larger than the thickness of the carrier blade, and said second long side edge of the carrier blade rests against the bottom of said chamber, wherein the chamber is so designed that it admits a certain tilting of the carrier blade in the recess while the carrier blade rests against said bottom.

5. The doctor blade device according to claim 1, wherein the spacer element is a separate part with respect to the lip means.

6. The doctor blade device according to claim 5, wherein said spacer element is divided into a number of successive spacer element parts.

7. The doctor blade device according to claim 1, wherein the lip means is divided into a number of successive lip parts.

8. The doctor blade device according to claim 7, wherein the number of spacer element parts is larger than the number of lip parts.

9. The doctor blade device according to claim 1, wherein the doctor blade has a width, which is 5% to 50% of the width of the carrier blade.

10. The doctor blade device according to claim 1, wherein the doctor blade has a width, which is 10% to 30% of the width of the carrier blade.

11. The doctor blade device according to claim 9, wherein the carrier beam comprises a second chamber formed between a second lip and a third lip, and a press blade extends from a bottom in said second chamber out between the second lip and the third lip to a line abutment against the carrier blade.

12. The doctor blade device according to claim 9, wherein the carrier beam comprises a second chamber formed between a second lip and a third lip, and a press blade extends from a bottom in said second chamber out between the second lip and the third lip to a line abutment against the carrier blade, in connection to the bottom of the groove for the doctor blade.

13. The doctor blade device according to claim 1, wherein the doctor blade has a length being several times larger than the length of the roll surface or the cylinder surface, against which the doctor blade will operate.

14. The doctor blade device according to claim 1, wherein the doctor blade has a length being several times larger than the length of the roll surface or the cylinder surface, against which the doctor blade will operate, wherein the ends of the doctor blade are joined to each other for the formation of a continuous doctor blade band.

15. The doctor blade device according to claim 13, wherein at least one long side edge of the doctor blade is ground to an angle of about 60° to about 90° in relation to the adjacent sides of the doctor blade in order to give a desired angle of about 80° to about 95° between the ground surface and a tangent to the roll surface, or the cylinder surface in the abutment point of the roll surface, or the cylinder surface.

16. The doctor blade device according to claim 13, wherein at least one long side edge of the doctor blade is ground to an angle of about 60° to about 90° in relation to the adjacent sides of the doctor blade in order to give a desired angle of about 80° to about 95° between the ground surface and a tangent to the roll surface, or the cylinder surface in the abutment point of the roll surface, or the cylinder surface, wherein both long side edges of the doctor blade are ground such that the doctor blade band has a rotation-symmetric cross-section, and that one band end at the joining of the ends is turned half a turn in relation to the other one for the formation of a Mobious-band with only one side and only one long side edge.

* * * * *